US009198531B2

(12) United States Patent
Dickerson et al.

(10) Patent No.: US 9,198,531 B2
(45) Date of Patent: Dec. 1, 2015

(54) CARPET INSTALLATION APPARATUS

(71) Applicant: Beno J. Gundlach Company, Belleville, IL (US)

(72) Inventors: Dennis R. Dickerson, Tilden, IL (US); Maurice L. Despins, Edmonton (CA); Gregory J. Gundlach, Belleville, IL (US)

(73) Assignee: Beno J. Gundlach Company, Belleville, IL (US)

( * ) Notice: Subject to any disclaimer, the term of this patent is extended or adjusted under 35 U.S.C. 154(b) by 0 days.

(21) Appl. No.: 13/747,359

(22) Filed: Jan. 22, 2013

(65) Prior Publication Data

US 2013/0193390 A1 Aug. 1, 2013

Related U.S. Application Data

(60) Provisional application No. 61/588,978, filed on Jan. 20, 2012.

(51) Int. Cl.
*B65H 77/00* (2006.01)
*A47G 27/04* (2006.01)

(52) U.S. Cl.
CPC ..... *A47G 27/0493* (2013.01)

(58) Field of Classification Search
CPC ..... A47G 27/0493; A47G 27/0487
USPC ..... 254/200, 204, 206, 207, 209, 211; 294/8.6
See application file for complete search history.

(56) References Cited

U.S. PATENT DOCUMENTS

| | | | | | |
|---|---|---|---|---|---|
| 70,023 | A | * | 10/1867 | Robinson | 254/206 |
| 487,544 | A | * | 12/1892 | Simon | 296/107.14 |
| 651,924 | A | * | 6/1900 | Johnson | 254/204 |
| 834,535 | A | * | 10/1906 | Poibot | 254/204 |
| 888,689 | A | * | 5/1908 | Bradbury | 254/204 |
| 1,033,552 | A | * | 7/1912 | Dehlinger | 254/204 |
| 1,489,789 | A | * | 4/1924 | Ryan | 33/461 |
| 1,747,178 | A | * | 2/1930 | Morse | 160/117 |
| 1,904,281 | A | * | 4/1933 | Ellingston | 244/202 |
| 3,556,479 | A | * | 1/1971 | Palachuk | 254/200 |
| 3,747,157 | A | * | 7/1973 | Szymanski | 16/5 |
| 3,752,440 | A | * | 8/1973 | Ream | 254/209 |
| 3,917,225 | A | * | 11/1975 | Payson | 254/210 |
| 4,008,879 | A | * | 2/1977 | Youngman | 254/201 |
| 4,105,169 | A | * | 8/1978 | Alinder et al. | 242/527.5 |
| 4,394,004 | A | * | 7/1983 | Allen et al. | 254/204 |
| 4,934,658 | A | * | 6/1990 | Berg et al. | 254/212 |
| 5,129,696 | A | * | 7/1992 | Underwood | 294/8.6 |
| 5,183,238 | A | * | 2/1993 | Sorensen | 254/209 |
| 5,286,003 | A | * | 2/1994 | Chuang | 254/103 |
| 5,288,057 | A | * | 2/1994 | Listau | 254/212 |
| 5,472,170 | A | * | 12/1995 | Anasson | 254/212 |

(Continued)

*Primary Examiner* — Emmanuel M Marcelo
*Assistant Examiner* — Michael Gallion
(74) *Attorney, Agent, or Firm* — Christopher J. Kulish

(57) ABSTRACT

A carpet installation apparatus is provided. The apparatus can have inner and outer telescoping tubes that are operated by a threaded rod wherein one end of the rod engages a nut or receiver on the inner tube and the other end of the rod extends through an end wall of the outer wall for attachment to a handle. Turning the handle rotates the rod and moves the inner tube inwardly or outwardly relative to the outer tube. The apparatus further includes legs extending substantially perpendicular to the tubes, the legs having pin blocks disposed on the ends thereof for gripping carpet during the installation of the carpet.

18 Claims, 4 Drawing Sheets

(56) References Cited

U.S. PATENT DOCUMENTS

| | | | | |
|---|---|---|---|---|
| 5,875,606 | A * | 3/1999 | Jensen | 52/741.41 |
| 6,009,927 | A * | 1/2000 | Peters | 156/577 |
| 6,491,284 | B1 * | 12/2002 | Jolly et al. | 254/209 |
| 6,669,173 | B1 * | 12/2003 | Dunn | 254/201 |
| 7,222,898 | B1 * | 5/2007 | Mei | 294/8.6 |
| 7,497,418 | B1 * | 3/2009 | Mei et al. | 254/205 |
| 2003/0047724 | A1 * | 3/2003 | Landreth et al. | 254/8 R |
| 2003/0107028 | A1 * | 6/2003 | Martin | 254/200 |
| 2005/0263746 | A1 * | 12/2005 | Carbajal | 254/200 |
| 2006/0060830 | A1 * | 3/2006 | Behr et al. | 254/209 |
| 2009/0057629 | A1 * | 3/2009 | Mei et al. | 254/205 |
| 2009/0127524 | A1 * | 5/2009 | Stenhouse | 254/200 |
| 2009/0195004 | A1 * | 8/2009 | Mei et al. | 294/8.6 |

* cited by examiner

CARPET INSTALLATION APPARATUS

TECHNICAL FIELD

The present disclosure is related to the field of carpet installation apparatuses, in particular, hand-operated tools for use in stretching carpet to aid in its installation.

BACKGROUND

It is known to use hand-operated tools to stretch carpet to aid in its installation. Such tools are cumbersome and often require considerable physical strength on the part of the installer. Different carpet stretching tools are often required depending on the type of carpet being installed and where it is installed.

It is, therefore, desirable to provide an apparatus for installing carpet that is easy to operate.

SUMMARY

An apparatus for stretching carpet is provided in the description herein. In some embodiments, the apparatus can comprise telescoping inner and outer tubes, wherein the inner tube can be inserted into the outer tube and can further travel inwardly and outwardly with respect to the outer tube. In some embodiments, the apparatus can comprise a threaded rod disposed within the telescoping tubes wherein one end of the threaded rod can be threadably engaged with a threaded nut or receiver disposed at the end of the inner tube inserted into the outer tube, and the other end of the threaded rod extending through an end wall of the outer tube and operatively coupled to a handle. When the handle is turned, the threaded rod can move the inner tube inwardly or outwardly relative to the outer tube, depending on the direction the handle is rotated.

In some embodiments, the apparatus can comprise substantially perpendicular legs extending therefrom, the ends of the legs having pin blocks operatively disposed or attached thereto, the pin block configured with a plurality of pins further configured to engage the backing of the carpet thereby enabling the pin block to grip or otherwise releasably attach to the carpet. In some embodiments, the pin block can comprise the pin block as described and shown in U.S. Pat. No. 7,237,764 issued on Jul. 3, 2007, which incorporated by reference into this application in its entirety.

In some embodiments, the apparatus can further comprise angle braces disposed between the telescoping tubes and the legs to provide additional strength and/or rigidity to the apparatus. In some embodiments, the apparatus can further comprise one or more thrust bearings disposed on the end of the outer tube where the handle is located, the thrust bearing or bearings configured to allow the threaded rod to pass through to the handle. In some embodiments, the outer tube can further comprise a reinforcing sleeve or cap disposed on the end that the inner tube is inserted to provide additional strength and/or rigidity to the apparatus. In some embodiments, the handle can further comprise a counterweight to let the handle return to a starting position where the counterweight is at a lower position when the apparatus is not being used.

Broadly stated, in some embodiments, a carpet installation apparatus is provided, comprising: a first tubular member comprising first and second ends defining a longitudinal axis and a passageway therebetween, the first end comprising a first opening, the second end comprising an end wall; a second tubular member comprising third and fourth ends, the second member configured for a telescoping fit within the passageway of the first member, the third end configured for insertion into the first opening and traveling along the passageway; a first leg extending substantially perpendicular from the second end of the first member, and a second leg extending substantially perpendicular from the fourth end of the second member, each of the first and second legs further configured for releasably coupling to a pin block; a threaded nut or receiver disposed on the third end of the second member; a threaded rod comprising fifth and sixth ends disposed in the passageway, the fifth end threadably engaged with the threaded nut, the sixth end passing through a second opening disposed through the end wall; and a handle operatively coupled to the sixth end and configured for rotating the threaded rod, wherein rotating the handle causes the threaded rod to rotate further causing the second member to telescope inwardly or outwardly with respect to the first member.

DETAILED DESCRIPTION

Figure 1:
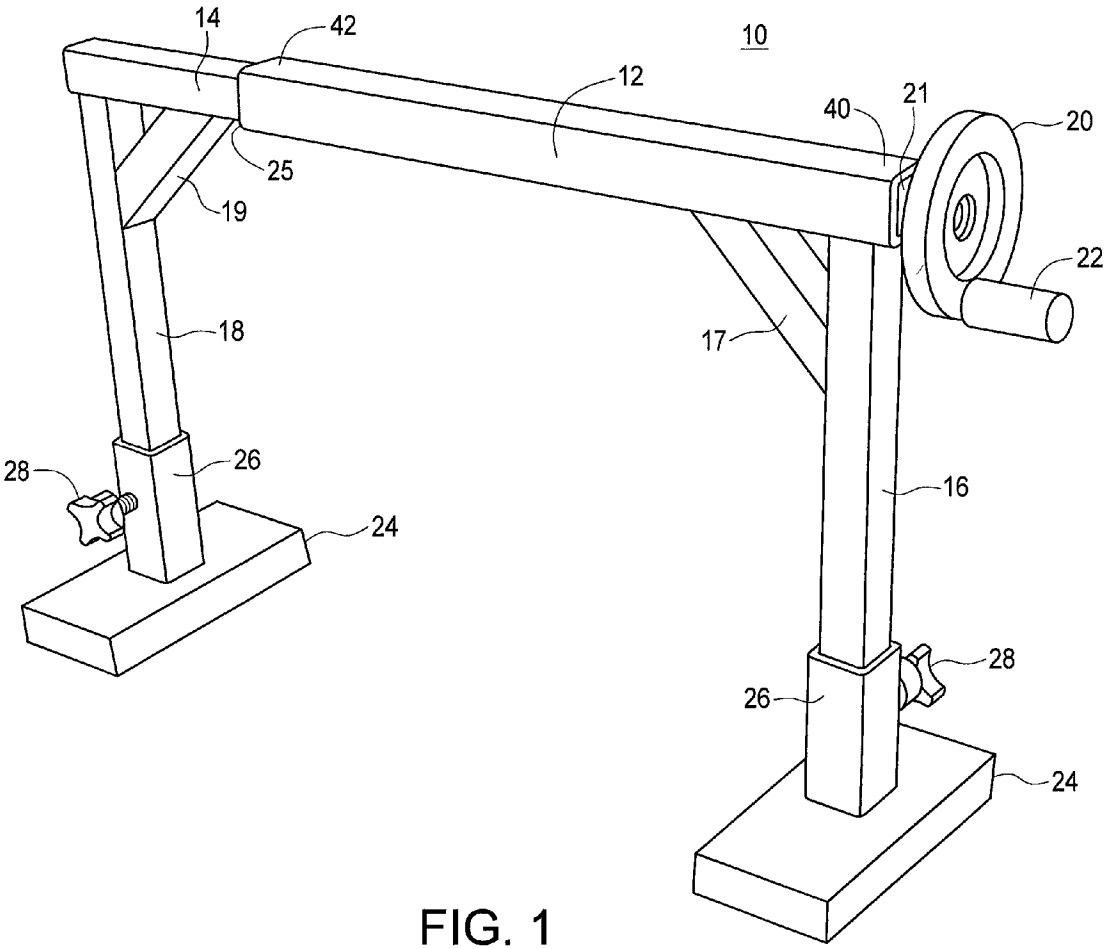
FIG. 1 is a perspective view depicting a first embodiment of a carpet installation apparatus.

Referring to FIGS. 1 through 4, an embodiment of a carpet installation, denoted as apparatus 10, is illustrated. Referring to FIG. 1, one embodiment of apparatus 10 is shown. In some embodiments, apparatus 10 can comprise outer telescoping tube 12 and inner telescoping tube 14. In some embodiments, tubes 12 and 14 can comprise rectangular tubing. In other embodiments, tubes 12 and 14 can comprise square tubing. In further embodiments, tubes 12 and 14 can comprise round tubing. In some embodiments, the tubing can be comprised of metal, such as steel, aluminum or of any other suitable metal as well known to those skilled in the art, or of combinations or alloys thereof. In other embodiments, the tubing can be comprised of plastic or composite materials.

In some embodiments, tube 12 can comprise leg 16 extending substantially perpendicular therefrom, and tube 14 can comprise leg 18 extending substantially perpendicular therefrom. In some embodiments, apparatus can further comprise angle brace 17 disposed between tube 12 and leg 16, and angle brace 19 disposed between tube 14 and leg 18 to provide additional structural strength and/or rigidity to apparatus 10. In some embodiments, braces 17 and 19 can be comprised of the same tubing material as tubes 12 and 14. In some embodiments, apparatus 10 can further comprise pin blocks 24 operatively coupled to legs 16 and 18. In some embodiments, pin blocks 24 can comprise receivers 26 configured to receive legs 16 and 18, and releasably couple thereto. In some embodiments, receivers 26 can further comprise fastening means for releasably coupling receivers 26 to legs 16 and 18. In the illustrated embodiment, receivers 26 can comprise fastening means 28 attached thereto to secure receivers 26 to legs 16 and 18. In some embodiments, fastening means 28 can comprise thumbscrews threadably attached to receivers 26 although other fastening means as well known to those skilled in the art can be used, such as telescoping spring pins and/or other functionally equivalent fastening devices.

Referring to FIGS. 1 to 4, in some embodiments, tube 14 can be inserted in opening 25 of tube end 42 of tube 12. Apparatus 10 can further comprise threaded rod 30 disposed in passageway 41, which can extend between tube end 40 and tube end 42 of tube 12, wherein one end of rod 30 can threadably engage threaded nut 32 disposed in opening 46 of tube end 50 of tube 14, and the other end of rod 30 can extend through opening 44 disposed through end wall 21 disposed on tube end 40 of tube 12 to operatively couple with handle 20. In some embodiments, threaded rod 30 and threaded nut 32 can comprise right-handed threads so that when handle 20 is turned clockwise, when viewed from the handle end of apparatus 10, tube 14 is drawn or telescoped inwardly into tube 12 thereby bringing legs 16 and 18 closer together. When handle 20 is turned counter-clockwise, tube 14 is pushed or telescoped outwardly from tube 12 thereby bringing moving legs 16 and 18 away from each other. When the pins of pin blocks 24 are facing towards each other and handle 20 is turned clockwise, apparatus 10 can be used to pull the edges of two pieces of carpet towards each other to be seamed together, as well known to those skilled in the art. When the pins of pin blocks 24 are facing away from each other and handle 20 is turned counter-clockwise, apparatus 10 can be used to stretch a piece of carpet during its installation. It is obvious to those skilled in the art that if threaded rod 30 and threaded nut 32 comprise left-handed threads, handle 20 can be turned in the apposite directions from those noted above to carry out the same installation activities.

Referring back to FIG. 1, in some embodiments, handle 20 can comprise a round disk with grip 22 rotatably attached thereto although it is obvious to those skilled in the art that handle 20 can comprise any functionally equivalent shape and/or structure.

Figure 2:
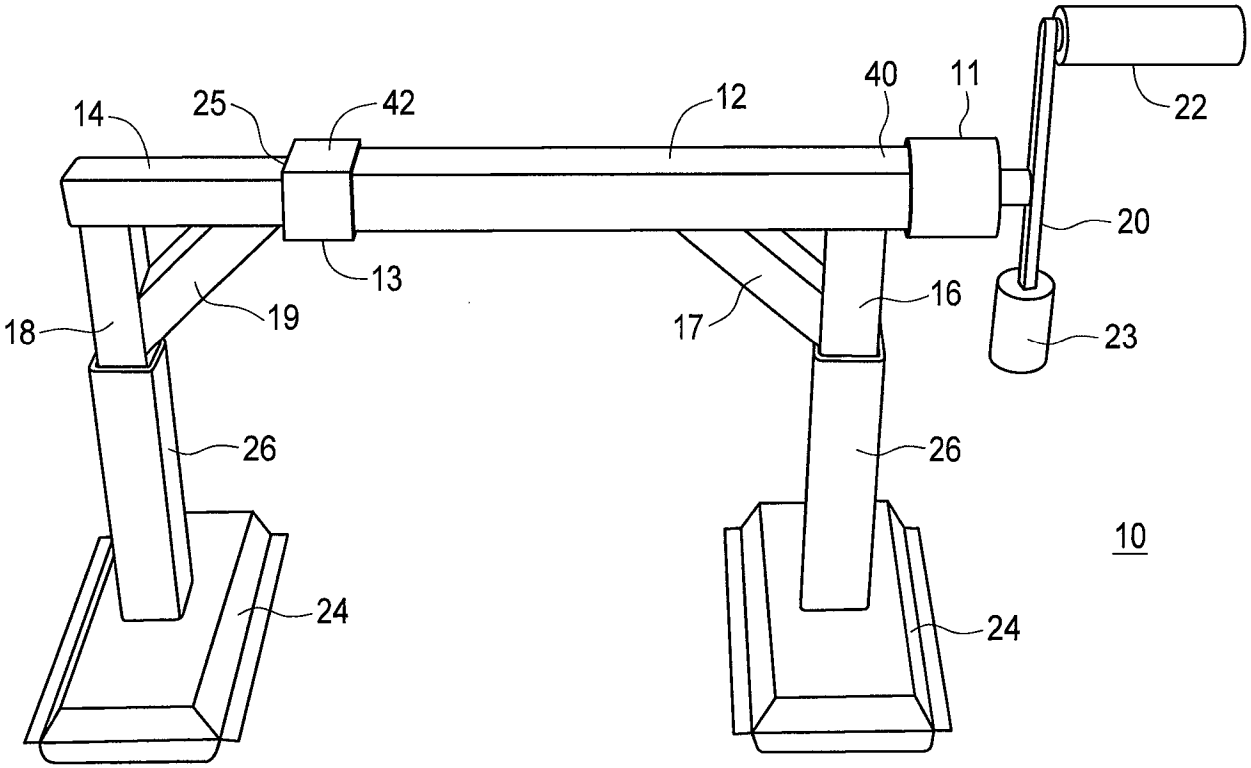
FIG. 2 is a front perspective view depicting a second embodiment of a carpet installation apparatus.

Referring to FIG. 2, a second embodiment of apparatus 10 is shown. In some embodiments, apparatus 10 can further comprise thrust bearing 11 disposed on tube end 40 of tube 12 to make the operation of apparatus 10 easier to use, and to permit the use of greater rotational force by an installer to handle 20. In some embodiments, thrust bearing 11 can comprise one or more bearings stacked in tandem to increase the load bearing and/or force capacity of apparatus 10, as obvious to those skilled in the art. In some embodiments, apparatus 10 can further comprise reinforcing sleeve 13 disposed on tube end 42 of tube 12 to provide more strength and/or rigidity to apparatus 10. In some embodiments, handle 20 can comprise a "T-shaped" configuration and further comprise grip 22 disposed thereon for turning handle 20. In other embodiments, handle 20 can further comprise counterweight 23 that can automatically rotate handle 20 where counterweight 23 is at a lower position, and grip 22 is at an upper position, when apparatus 10 is not being used by an installer. In the illustrated embodiment, receivers 26 can be longer in length when greater height underneath tubes 12 and 14 are required when installing carpet, such as when apparatus 10 is being used to seam two pieces of carpet together as increased height underneath tubes 12 and 14 can allow a seaming iron to pass thereunder to complete the seam.

Figure 3:
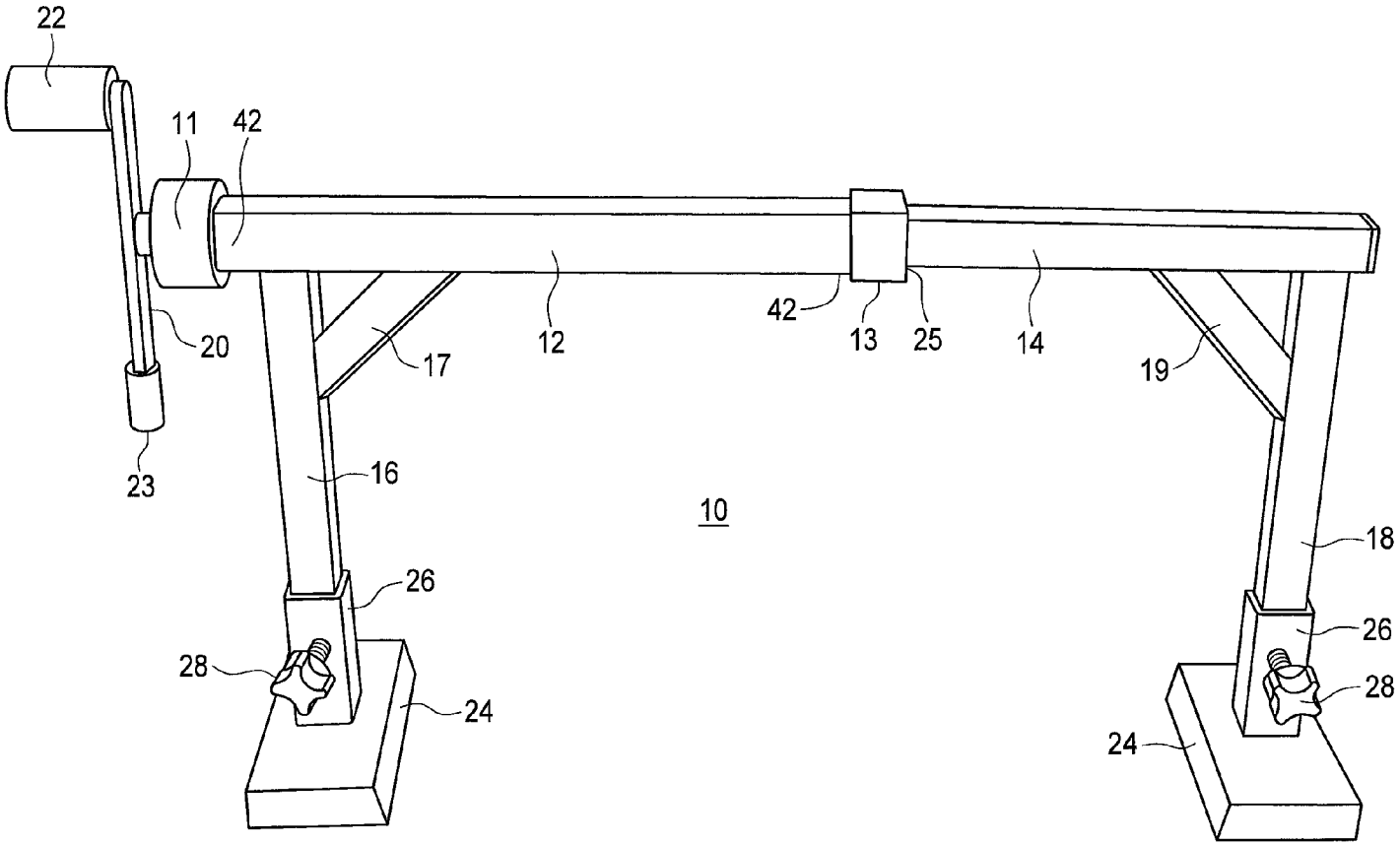
FIG. 3 is a front perspective view depicting a third embodiment of a carpet installation apparatus.
Figure 4:
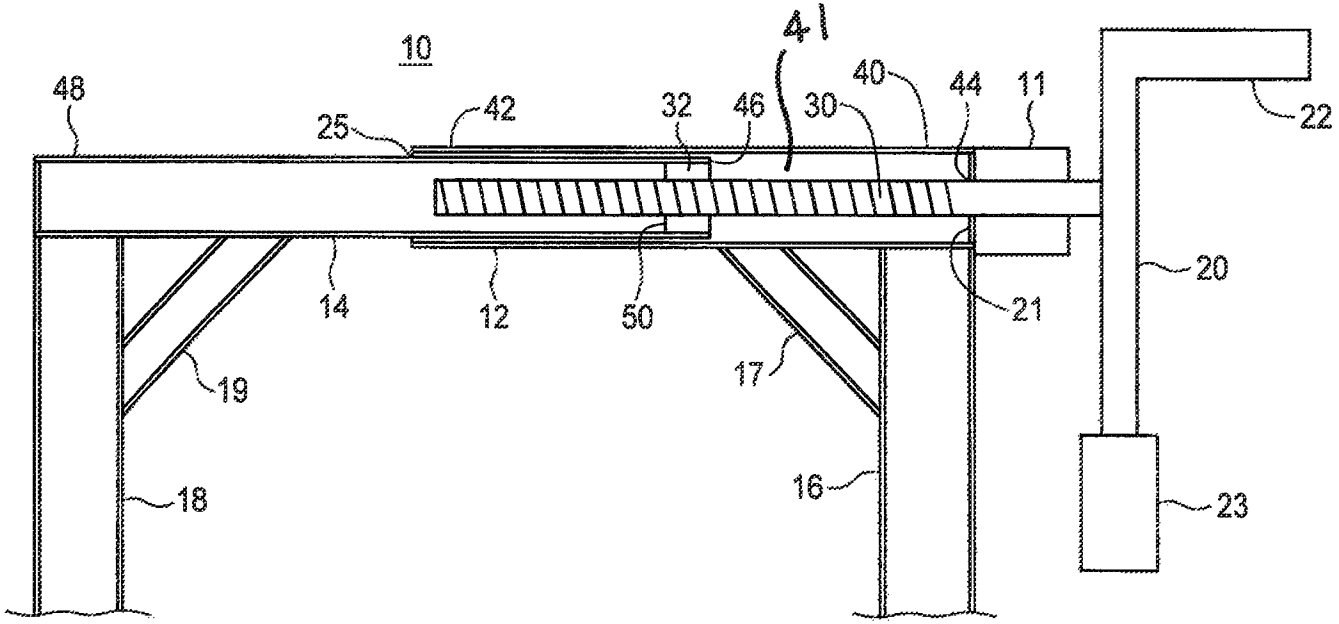
FIG. 4 is a cross-section side elevation view depicting the internal mechanism of a carpet installation stretching apparatus.

Referring to FIG. 3, a third embodiment of apparatus 10 is shown. In this embodiment, apparatus 10 is similar to the embodiment of apparatus 10 shown in FIG. 2 except that apparatus 10 comprises the pin blocks 24 and receivers 26 of the embodiment of apparatus 10 shown in FIG. 1.

Although a few embodiments have been shown and described, it will be appreciated by those skilled in the art that various changes and modifications can be made to these embodiments without changing or departing from their scope, intent or functionality. The terms and expressions used in the preceding specification have been used herein as terms of description and not of limitation, and there is no intention in the use of such terms and expressions of excluding equivalents of the features shown and described or portions thereof, it being recognized that the invention is defined and limited only by the claims that follow.

We claim:

1. A carpet installation apparatus, comprising:

a first tubular member comprising: (a) a first tubular wall having a first end and a second end and extending from a first terminal surface to a second terminal surface, the first tubular wall defining a linear passageway located within the first tubular wall and extending from the first terminal surface to the second terminal surface, the first tubular wall also having a linear longitudinal axis, the first terminal end defining a first opening, and (b) and an end wall, wherein the end wall operatively engages the second end of the first tubular wall and extends transverse to the linear longitudinal axis of the first tubular wall;

a second tubular member configured for a telescoping fit within the linear passageway of the first tubular member, the second tubular member having a third end configured for insertion into the first opening and traveling along the passageway and a fourth end;

a first leg extending substantially perpendicular from and operatively attached to the second end of the first tubular member, the first leg configured for releasably coupling to a first pin block for engaging a carpet, the first pin block comprising a first plurality of pins and a first block for supporting the first plurality of pins in a first plane;

a second leg extending substantially perpendicular from and operatively attached to the fourth end of the second tubular member, the second leg configured for releasably coupling to a second pin block for engaging a carpet, the second pin block comprising a second plurality of pins and a second block for supporting die second plurality of pins in a second plane, wherein the second pin block is not the first pin block;

a threaded nut or receiver fixedly disposed on and adjacent to the third end of the second tubular member, the threaded nut having one of a right hand thread and a left hand thread;

a threaded rod comprising fifth and sixth ends; the same one of the right hand thread and left hand thread as the threaded nut, and substantially disposed in the linear passageway, the fifth end threadably engaged with the threaded nut, the sixth end passing through a second opening disposed through the end wall; and a handle operatively coupled to the sixth end of the threaded rod and configured for rotating the threaded rod, wherein rotating the handle in a clockwise/counterclockwise direction causes the threaded rod to rotate in a clockwise/counterclockwise direction and further causing the second tubular member to telescope inwardly/outwardly with respect to the first tubular member and position the first and second legs nearer/farther to/from one another.

2. The apparatus as set forth in claim 1, further comprising angle braces disposed between the first tubular member and the first leg, and between the second tubular member and the second leg.

3. The apparatus as set forth in claim 1, wherein the first and second tubular members are comprised of rectangular tubing.

4. The apparatus as set forth in claim 3, wherein the first and second tubular members are comprised of square tubing.

5. The apparatus as set forth in claim 1, wherein the first and second tubular members are comprised of round tubing.

6. The apparatus as set forth in claim 1, further comprising a thrust bearing disposed on the second end, wherein the thrust bearing is configured to allow the threaded rod to pass therethrough before operatively coupling with the handle.

7. The apparatus as set forth in claim 1, wherein the handle further comprises a counterweight.

8. The apparatus as set forth in claim 1, wherein each of the first and second pin blocks further comprise a receiver for releasably coupling to the first and second legs.

9. The apparatus as set forth in claim 8, wherein the receiver further comprises fastening means for releasably securing the pin blocks to the legs.

10. The apparatus as set forth in claim 1, wherein the threaded nut or receiver is fixedly disposed within the second tubular member.

11. The apparatus as set forth in claim 1, wherein:

the first leg comprises a first leg longitudinal axis;

the second leg comprises a second leg longitudinal axis;

wherein the first and second leg longitudinal axes are substantially perpendicular to the longitudinal axis of the first tubular member;

wherein the first leg is configured to releasably support a first pin block such that the first plane of the first plurality of pins associated with the first pin block is substantially perpendicular to the first leg longitudinal axis; and wherein the second leg is configured to releasably support a second pin block such that the second plurality of pins associated with the second pin block is substantially perpendicular to the second leg longitudinal axis.

12. The apparatus as set forth in claim 11, further comprising angle braces disposed between the first tubular member and the first leg, and between the second tubular member and the second leg.

13. The apparatus as set forth in claim 12, wherein the first and second tubular members are comprised of rectangular, square or round tubing.

14. The apparatus as set forth in claim 11, further comprising a thrust bearing disposed on the second end, wherein the thrust bearing is configured to allow the threaded rod pass therethrough before operatively coupling with the handle.

15. The apparatus as set forth in claim 11, wherein the handle further comprises a counterweight.

16. The apparatus as set forth in claim 11, wherein each of the first and second pin blocks further comprise a receiver for releasably coupling to the first and second legs.

17. The apparatus as set forth in claim 16, wherein the receiver further comprises fastening means for releasably securing the pin blocks to the legs.

18. The apparatus as set forth in claim 11, wherein the threaded nut or receiver is fixedly disposed within the second tubular member.

* * * * *